US007484989B2

(12) United States Patent
Venaleck

(10) Patent No.: US 7,484,989 B2
(45) Date of Patent: Feb. 3, 2009

(54) LOW FRICTION CABLE ASSEMBLY LATCH

(75) Inventor: John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 11/942,888

(22) Filed: Nov. 20, 2007

(65) Prior Publication Data

US 2008/0124973 A1 May 29, 2008

Related U.S. Application Data

(60) Provisional application No. 60/861,631, filed on Nov. 29, 2006.

(51) Int. Cl.
*H01R 13/627* (2006.01)

(52) U.S. Cl. ..... 439/352; 439/358

(58) Field of Classification Search ..... 439/352, 439/357, 358, 372, 923
See application file for complete search history.

(56) References Cited

U.S. PATENT DOCUMENTS

| | | | | |
|---|---|---|---|---|
| 4,655,518 | A | | 4/1987 | Johnson et al. |
| 4,655,578 | A | | 4/1987 | Kurtz et al. |
| 4,659,155 | A | | 4/1987 | Walkup et al. |
| 4,755,145 | A | | 7/1988 | Johnson et al. |
| 4,846,727 | A | | 7/1989 | Glover et al. |
| 4,869,677 | A | | 9/1989 | Johnson et al. |
| 4,961,711 | A | * | 10/1990 | Fujiura et al. ..... 439/357 |
| 4,976,628 | A | | 12/1990 | Fedder |
| 4,984,992 | A | | 1/1991 | Beamenderfer et al. |
| 5,046,960 | A | | 9/1991 | Fedder |
| 5,055,069 | A | | 10/1991 | Townsend et al. |
| 5,066,236 | A | | 11/1991 | Broeksteeg |
| 5,104,329 | A | | 4/1992 | Brown et al. |
| 5,104,341 | A | | 4/1992 | Gilissen et al. |
| 5,151,036 | A | | 9/1992 | Fusselman et al. |
| 5,154,629 | A | * | 10/1992 | Carver et al. ..... 439/352 |
| 5,174,770 | A | | 12/1992 | Sasaki et al. |
| 5,238,414 | A | | 8/1993 | Yaegashi et al. |
| 5,286,212 | A | | 2/1994 | Broeksteeg |
| 5,342,211 | A | | 8/1994 | Broeksteeg |
| 5,403,206 | A | | 4/1995 | McNamara et al. |

(Continued)

FOREIGN PATENT DOCUMENTS

| | | |
|---|---|---|
| WO | 03084003 | 10/2003 |

*Primary Examiner*—Thanh-Tam T Le
(74) *Attorney, Agent, or Firm*—Renner, Otto, Boisselle & Sklar, LLP

(57) ABSTRACT

A latch end for an electrical connector latch has a low coefficient of friction latch mating surface that engages with a mating slot in a mating electrical connector. The latch pivots around a central pivot point to move the latch end inward toward the center of the connector to engage the mating slot, or outward away from the center of the connector to disengage from the slot. The low friction mating surface may be a plastic overmold or a low friction coating on a metal hook of the latch end. The metal hook provides strength to the latch end. The low friction mating surface provides for a lower coefficient of friction and perhaps a larger contact area between the mating surface and the mating slot or protrusion. The latch engages a mating structure in the mating electrical connector. The mating electrical connector may have prongs that engage corresponding receptacles.

2 Claims, 4 Drawing Sheets

U.S. PATENT DOCUMENTS

| | | | | |
|---|---|---|---|---|
| 5,435,757 | A | 7/1995 | Fedder et al. | |
| 5,443,403 | A | 8/1995 | Weidler et al. | |
| 5,460,533 | A | 10/1995 | Broeksteeg et al. | |
| 5,484,310 | A | 1/1996 | McNamara et al. | |
| 5,496,183 | A | 3/1996 | Soes et al. | |
| 5,525,066 | A | 6/1996 | Morlion et al. | |
| 5,620,340 | A | 4/1997 | Andrews | |
| 5,632,634 | A | 5/1997 | Soes | |
| 5,632,635 | A | 5/1997 | Vanbesien et al. | |
| 5,660,551 | A | 8/1997 | Sakurai | |
| 5,664,968 | A | 9/1997 | Mickievicz | |
| 5,702,258 | A | 12/1997 | Provencher et al. | |
| 5,775,947 | A | 7/1998 | Suzuki et al. | |
| 5,795,191 | A | 8/1998 | Preputnick et al. | |
| 5,860,816 | A | 1/1999 | Provencher et al. | |
| 5,882,214 | A | 3/1999 | Hillbish et al. | |
| 6,102,747 | A | 8/2000 | Paagman | |
| 6,146,202 | A | 11/2000 | Ramey et al. | |
| 6,270,382 | B1 | 8/2001 | Droesbeke et al. | |
| 6,371,773 | B1 | 4/2002 | Crofoot et al. | |
| 6,471,547 | B1 | 10/2002 | Venaleck et al. | |
| 6,524,135 | B1 | 2/2003 | Feldman et al. | |
| 6,780,069 | B2 | 8/2004 | Scherer et al. | |
| 6,857,899 | B2 | 2/2005 | Reed et al. | |
| 6,866,542 | B2 * | 3/2005 | Murayama | 439/565 |
| 6,910,911 | B2 * | 6/2005 | Mellott et al. | 439/358 |
| 6,953,356 | B2 * | 10/2005 | Hisamatsu et al. | 439/258 |
| 6,953,361 | B2 * | 10/2005 | Li et al. | 439/358 |
| 7,001,200 | B2 * | 2/2006 | Yoshie | 439/358 |
| 2003/0124881 | A1 | 7/2003 | Avery et al. | |
| 2003/0186594 | A1 | 10/2003 | Feldman et al. | |
| 2005/0112920 | A1 | 5/2005 | Venaleck et al. | |

* cited by examiner

LOW FRICTION CABLE ASSEMBLY LATCH

Priority is claimed under 35 USC 119 to U.S. Provisional Application No. 60/861,631, filed Nov. 29, 2006, which is incorporated herein by reference in its entirety.

RELATED APPLICATION

Reference is made to U.S. Patent Application Pub. No. 2005/0112920 A1, published May 26, 2005, which is incorporated herein by reference in its entirety.

TECHNICAL FIELD

The invention is in the general field of electrical connectors.

BACKGROUND OF THE INVENTION

Latches for retaining cable assemblies to their mating connectors have many designs. Of these designs, many use the same motion for unlatching as for extraction. That is, to remove an assembly from its mating connector, one would most naturally pull on the plug end. It is most desirable that this same pulling action effects the unlatching. Conversely, when mating the plug with its connector, the most common designs automatically latch using a combination of a spring and a ramp.

Regardless of feature shape or specific design, one principle applies to all: when pulling to disengage the connector, ramp-spring friction will resist movement of the latch. The friction that exists between the latch and its mate is a function of the pulling force on the connector, which causes a normal force between the latch and its mating part, and the coefficient of friction between the latch and the mating part. The pulling force on the latch to effect the unlatching is the sum of the force required to compress the spring that biases the position of the latch, and any other force imposed; for example, the weight of a hanging cable. The net mechanical advantage of the latch actuating mechanism must overcome this friction or the latch will not function.

From the foregoing it will be appreciated that there is the possibility of improvements for such latches.

SUMMARY OF THE INVENTION

According to an aspect of the invention, an a electrical connector latch has a low coefficient of friction surface, such as coating or an overmolded plastic, on its metal end. The metal end may be a hooked metal end that provides strength.

According to another aspect of the invention, an electrical connector includes: a connector body; a pair of latches having latch ends that pivot relative to the connector body about pivots of the latches; a pair of springs that bias the latch ends toward an engaged position, for engaging mating slots or protrusions of a mating connector; and a pair of ramps that cooperate with the springs to pivot the latch ends from the engaged position to a disengaged position, for disengaging from the mating slots or protrusions. The latch ends have low coefficient of friction mating surfaces for engaging the mating slots when the latch ends are in the engaged position.

According to yet another aspect of the invention, a pair of mated electrical parts include a cable assembly and a mating connector. The cable assembly includes a connector body that encloses electrical contacts; and a pair of latches having latch ends that pivot relative to the connector body about pivots of the latches. The mating connector, which is mechanically and electrically coupled with the electrical connector, includes matting connector electrical contacts that mate with the electrical contacts of the cable assembly; and engagement structures on opposite sides of the matting connector electrical contacts. The engagement structures each have one or more prongs that engage corresponding receptacles in the connector body of the cable assembly.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A latch end for an electrical connector latch has a low coefficient of friction latch mating surface that engages with a mating slot in a mating electrical connector. The latch pivots around a central pivot point to move the latch end inward toward the center of the connector to engage the mating slot, or outward away from the center of the connector to disengage from the slot. The low friction mating surface may be a plastic overmold or a low friction coating on a metal hook of the latch end. The metal hook provides strength to the latch end. The low friction mating surface provides for a lower coefficient of friction and perhaps a larger contact area between the mating surface and the mating slot or protrusion. This reduces the friction forces that oppose disengagement of the latch by pulling on the body of the electrical connector. The latch may be biased into engagement with the mating slot by a ramp-and-spring mechanism of the electrical connector. The mechanism has a spring that pushes out against the latch on one side of the central pivot, causing the latch end on the other side of the pivot to be pushed inward. A ramp on the connector body may push inward against the latch, counteracting the spring force, when the electrical connector is pulled to disengage it from its mating connector. The inward push by the ramp causes the latch end to move outward, a move that is opposed by friction between the latch end and the mating slot. By reducing friction between the latch end and the mating slot, easier disengagement between the electrical connector and the mating connector is facilitated.

Figure 1:
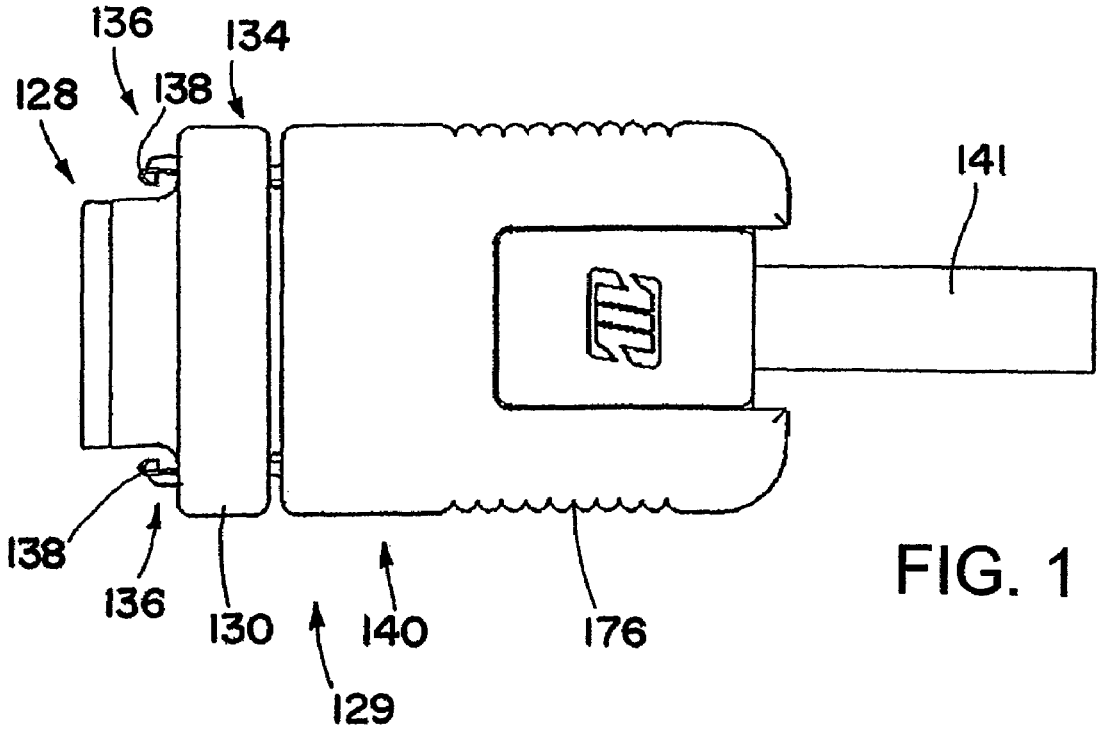
FIG. 1 is a plan view of a cable assembly in accordance with an embodiment of the present invention.
Figure 2:
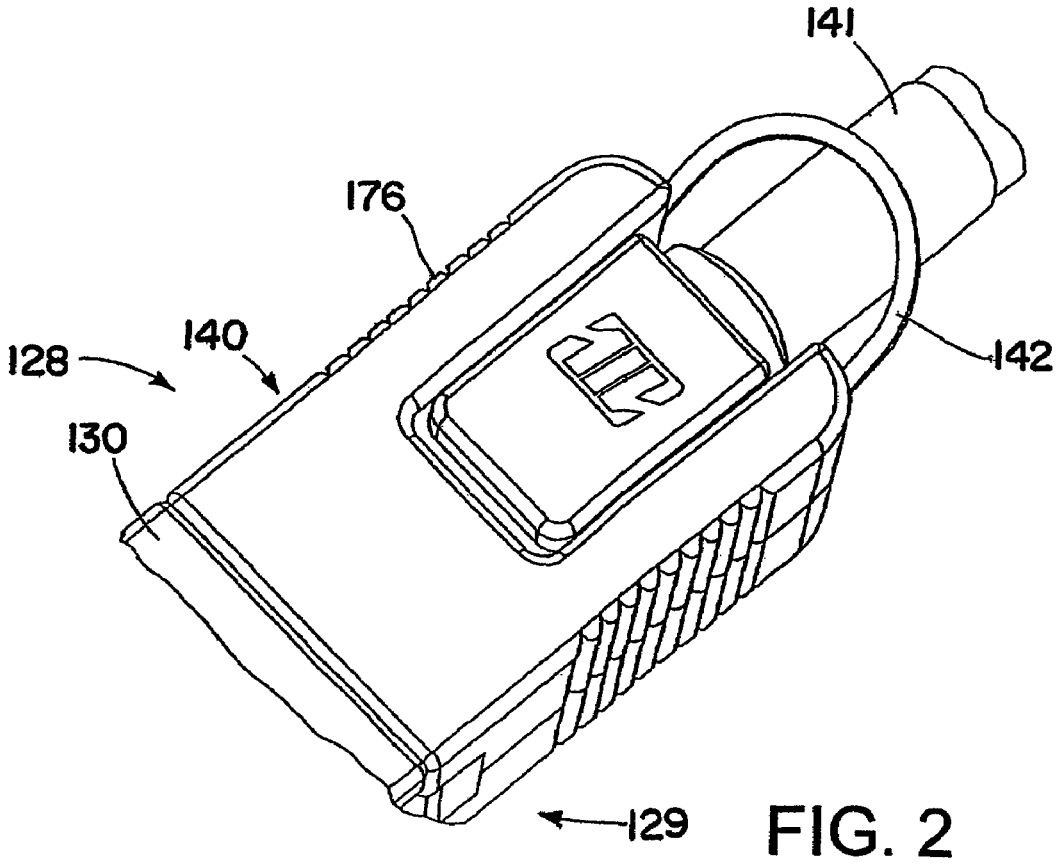
FIG. 2 is an oblique view of a variant of the cable assembly of FIG. 1, using a pull loop.
Figure 3:
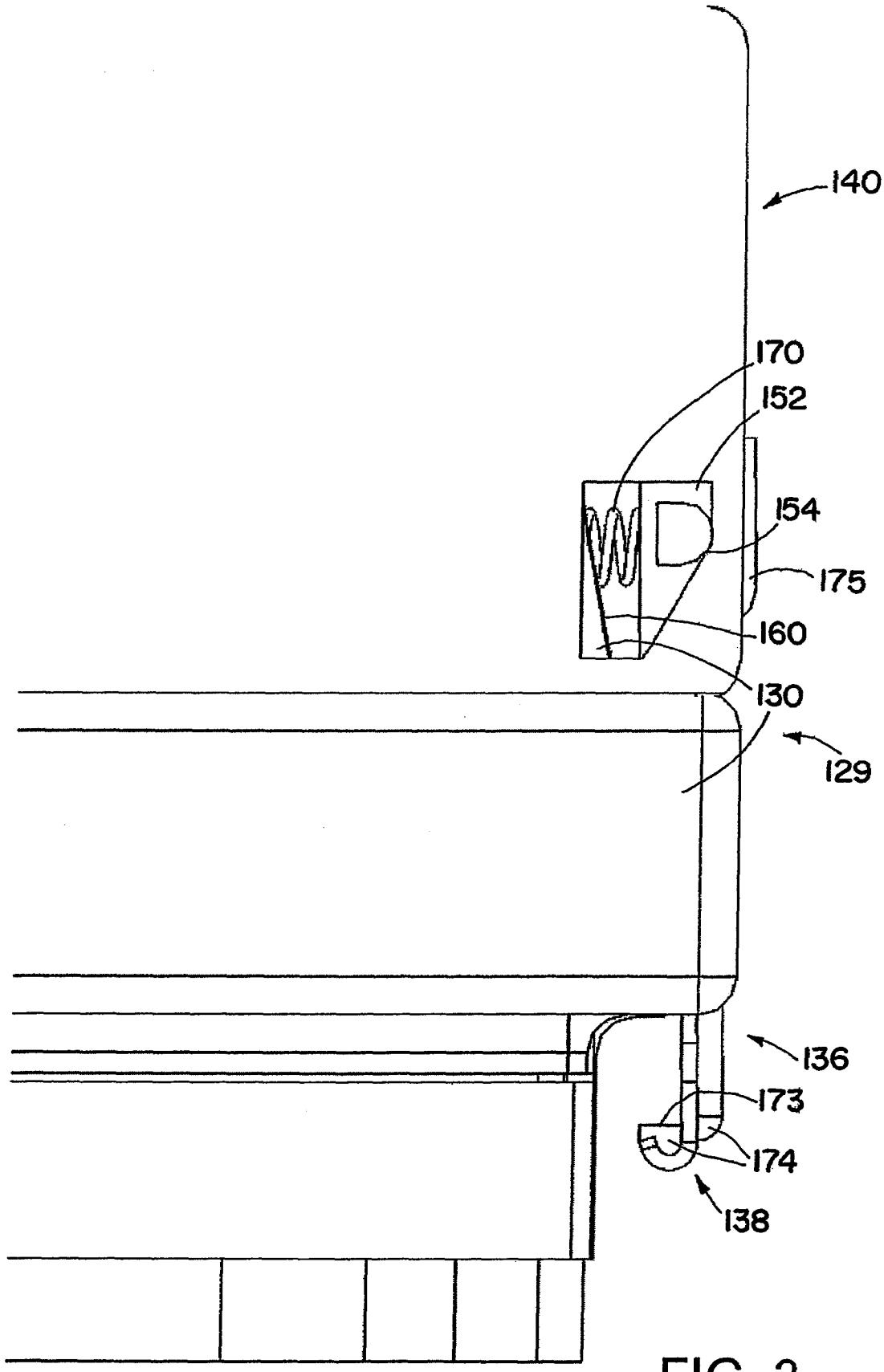
FIG. 3 is a plan view of a portion of a cable assembly in accordance with an embodiment of the present invention.

FIGS. 1-3 illustrate a straight-connect male cable assembly 128 that includes a connector body 129 that in turn includes a back shell 130 and a translatable grip portion 140. A cable 141 is coupled to contacts in the back shell 130. The back shell 130 is a metal body that encloses electrical contacts, and the translatable grip portion 140 is a plastic piece that is translatable relative to the back shell 130. The back shell 130 partially encloses a latch-release mechanism 134 for releasing a pair of latches 136. The translatable grip portion 140 is mechanically coupled to the latches 136 such that pulling the grip portion 140 causes latch ends 138 of the latches 136 to move outward and release. As shown in FIG. 2, the latch release mechanism 134 may include a pull loop 142 that is attached to the grip portion 140, to aid in gripping and pulling on the grip portion 140 to release the latches 138.

Figure 4:
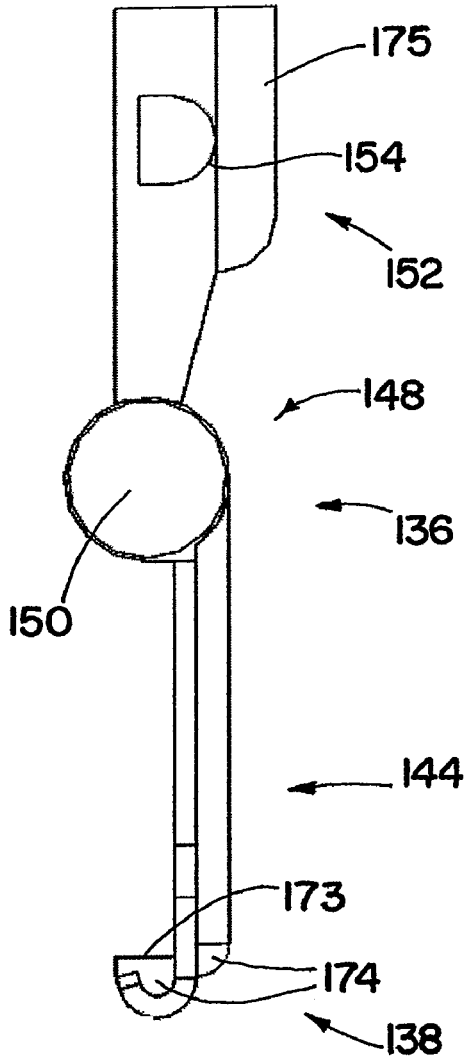
FIG. 4 is a plan view of a latch of the cable assembly of FIG. 3.

Referring now in addition to FIG. 4, details of interior workings of the latch release mechanism 134 are described. The latch end 138 is attached to and emerges from a first end 144 of the latch 136. A rocker arm 148 of the latch 136 may be overmolded onto the metal latch end 138. The latch 136 rotates about an axis or pivot 150, to release the latch end 138. On a second end 152 of the latch 136, there are top and bottom cam surfaces 154, only one of which is shown in FIGS. 3 and 4.

As the grip portion 140 is pulled back, in the direction of the cable 12, a ramp or sloped surface 160 of the grip portion 140 presses against the cam surfaces 154, deflecting the second end 152 of the latch 136 inward, against the force of a biasing spring 170. A similar ramp or sloped surface on a top half of the grip portion 140 presses against the top cam surface 154. As the second end 152 of the latch 136 is pressed inward, the latch 136 rotates about its axis 150, moving the first end 144 of the latch 136 outward. This moves the latch end 138 outward as well, releasing the latch end 138, and allowing the cable assembly 128 to be disengaged from a mating female connector.

The biasing spring 170 is between the back shell 130 and an inner surface 172 of the second end 152 of the latch 136. The biasing spring 170 fits into a recess in the inner surface of the second end 152, and serves to always press the second end 152 of the rocker 148 outward. When the grip portion 140 is released, the grip portion 140 translates back along the back shell 130, allowing the latch end 138 to engage, driven by the biasing spring 170.

The latch end 138 includes a hook made of a suitable metal, such as steel. The metal hook of the latch end 138 provides strength to the latch end 138. The latch end 138 also has low coefficient of friction mating surface 173 that engages a slot or protrusion of a mating electrical connector. The first end 144 of the latch 136 may have a plastic overmold 174 that includes the low coefficient of friction mating surface 173. The mating surface 173 may be at a substantially a right angle to a length of the latch 136 extending from the pivot 150 to the latch end 138.

The low coefficient of friction mating surface 173 provides reduced friction between the latch end 138 and the mating slot or protrusion on a female connector. In comparison with latches that involve metal latch ends, such as bare metal hooks, as a mating surface, the low friction mating surface provides for a lower coefficient of friction. In addition, the low friction mating surface may provide a larger contact area that a bare metal end between the mating surface and the mating slot. This reduces the friction forces that oppose disengagement of the latch by pulling on the body of the electrical connector. It will be appreciated that the pull on the connector 130 by the cable 141 may also cause normal forces on the mating surface 173, which produce frictional forces. By reducing friction between the latch end and the mating slot, easier disengagement between the electrical connector and the mating connector is facilitated.

As an alternative to the plastic overmold 174, the low coefficient of friction mating surface 173 may be a suitable low friction coating on metal parts of the latch end 138.

The latch release mechanism 134 provides an intuitive mechanism for disengaging the cable assembly from a female connector. The same pulling action that disengages the latch ends 138 is also used for pulling the cable assembly 128 away from the female connector. A pull loop 142 may be provided as an alternate mechanism for disengaging the latch ends 132.

As an alternate way of releasing the latch 136, an outer protrusion 175 of the latch second end 152 may protrude outside of the grip portion 140. Depressing the protrusion 175 causes the latch 136 to pivot, and the latch end 138 to thereby disengage. It will be appreciated that the latch release mechanism 134 provides a large mechanical advantage, which allows release of the latch ends 138 with a small force. The amount of mechanical advantage may be varied by varying suitable dimensions of the latch release mechanism 134, for example by varying the slope of the sloped surfaces of the back shell portions.

The back shell 130 may be made of a suitable metal, such as aluminum or steel. The grip portion 140 may be made of a suitable plastic material. The grip portion 140 may have a ridged gripping surface 176, to aid in gripping and pulling on the grip portion 140.

Figure 5:
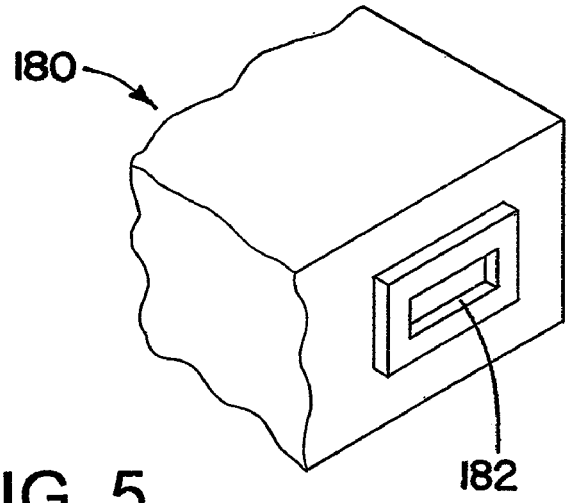
FIG. 5 is an oblique view of part of one embodiment of a female connector that mates with the cable assemblies of FIGS. 1-3.

FIG. 5 shows a portion of a female electrical connector 180 for mating with and engaging the cable assembly 128 (FIG. 1). In FIG. 5 the female electrical connector 180 has mating slots 182 that are engaged by the mating surfaces 173 of the latch ends 138.

Figure 6:
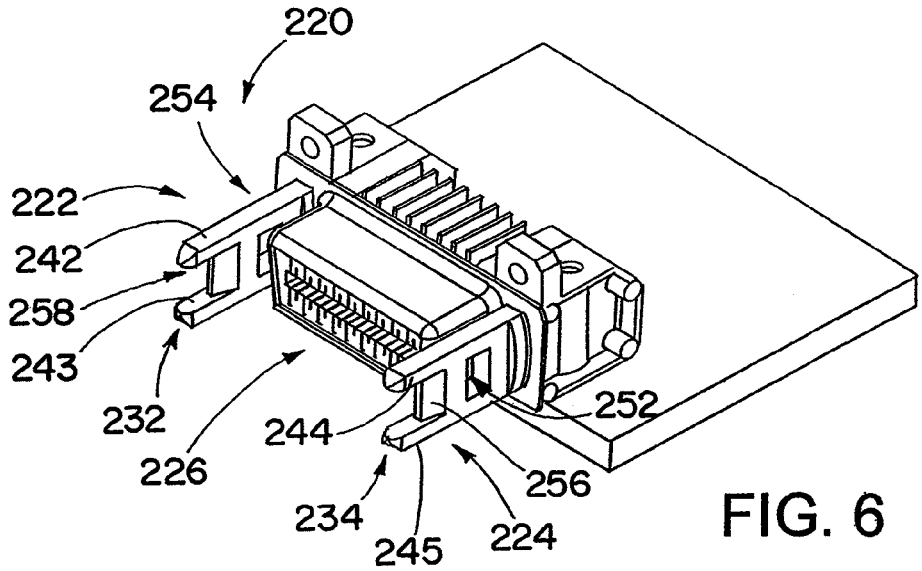
FIG. 6 is an oblique view of another embodiment female connector that is capable of mating with the cable assemblies of FIGS. 1-3.
Figure 7:
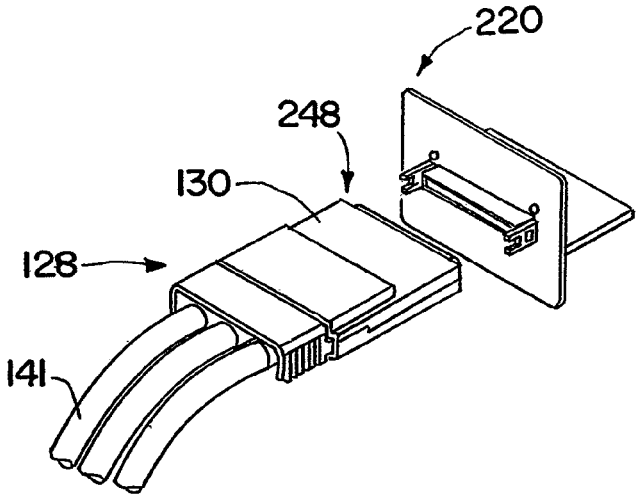
FIG. 7 is an oblique view showing the cable assembly of FIGS. 1-3, and the female connector of FIG. 6.
Figure 8:
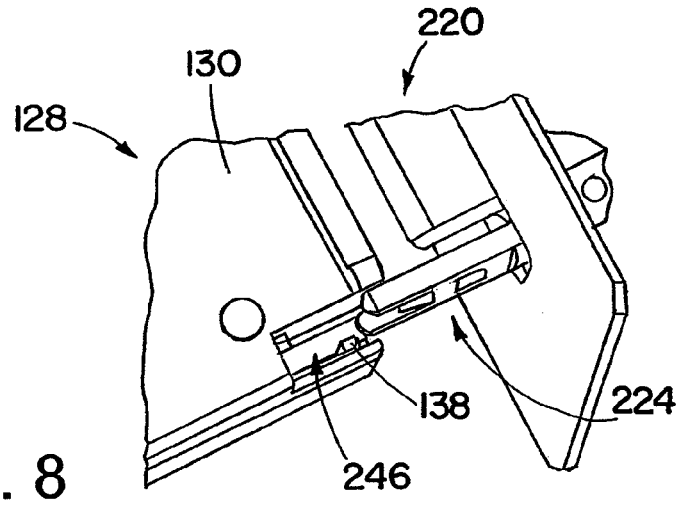
FIG. 8 is a close-up view illustrating the mating of a cable assembly of FIGS. 1-3 and the female connector of FIG. 6.

FIGS. 6-8 show another embodiment mating female electrical connector 220, for use with the cable assembly 128. The electrical connector 220 includes engagement structures 222 and 224 on opposite sides of electrical contacts 226. The electrical contacts 226 are configured to mate with electrical contacts in the back shell 130. The engagement structures 222 and 224 include respective pairs of prongs or posts 232 and 234 for engaging the back shell 130 of the cable assembly 128. The prong pair 232 includes an upper prong 242 and a lower prong 243, and the prong pair 234 includes an upper prong 244 and a lower prong 245. The prongs of each prong pair fit into the back shell 130. In doing so the prongs 242-245 help secure the back shell 130 and provide a structural load path to prevent strain on the contacts and latching mechanism of the cable assembly 128 and the electrical connector 220. Forces may pull in one direction or another on the cable assembly 130, such as forces on the cable 141 or forces from the weight of the cable 141. In the absence of the prongs 242-245 these forces are transmitted to the contacts and the latching mechanism. The prongs 242-245 keep these stresses from being transmitted to the contacts and the latching mechanism. Upward or downward forces on the back shell 130 are transmitted to the prongs 242-245, preventing interference with the operation of the latching mechanism or with the connection between the electrical contacts. The prongs or posts 242-245 support the weight of the cable 141, allowing smooth operation of the latching mechanism.

The prongs 242-245 may engage open slots 246 in the back shell 130. Alternatively the prongs 242-245 may engage recesses 248 in the back shell 130 that are partially closed, open only where the slots receive the prongs 242-245 and other parts of the engagement structures 222 and 224. The slots 246 and recesses 248 are collectively referred to herein as "receptacles."

The engagement structures 222 and 224 also have respective slots 252 and 254 for receiving and engaging the latch ends 138 of the cable assembly 128. The slots 252 and 254 have a rectangular shape. Ramps 256 and 258 on the structures 222 and 224 may be used to urge the latch ends 138 outward as the back shell 130 is engaged with the electrical connector 220. As the back shell 130 is inserted further the latch ends 138 reach the slots 252 and 254. There the latch ends 138 snap inwards, engaging the slots 252 and 254 and latching the parts together.

The engagement structures 222 and 224 may each be a single piece of material. The material may be any suitable material, such as a suitable metal or plastic.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A pair of mated electrical parts comprising:

a cable assembly that includes:

a connector body that encloses electrical contacts; and a pair of latches having latch ends that pivot relative to the connector body about pivots of the latches; and a mating connector mechanically and electrically coupled with the electrical connector, wherein the mating connector includes:

mating connector electrical contacts that mate with the electrical contacts of the cable assembly; and engagement structures on opposite sides of the matting connector electrical contacts;

wherein the engagement structures enclose respective slots that receive and engage the latch ends;

wherein the engagement structures each has one or more prongs that protrude away from the slots and toward the cable assembly, and that engage corresponding receptacles in the connector body of the cable assembly; and wherein the prongs include pairs of prongs that each include an upper prong and a lower prong on opposite sides of one of the latch ends.

2. The pair of mated electrical parts of claim 1, wherein the engagement structures have mating slots that engage the latches of the cable assembly.

* * * * *